United States Patent [19]

Wetzel

[11] 4,132,476

[45] Jan. 2, 1979

[54] ELECTRO-PHOTOGRAPHIC COPIER WITH ANTI-SPILL ARRANGEMENT

[75] Inventor: Günter Wetzel, Haar, Fed. Rep. of Germany

[73] Assignee: AGFA-GEVAERT AG, Leverkusen, Fed. Rep. of Germany

[21] Appl. No.: 702,863

[22] Filed: Jul. 6, 1976

[30] Foreign Application Priority Data

Jul. 4, 1975 [DE] Fed. Rep. of Germany ..... 2529835

[51] Int. Cl.[2] ..... G03G 15/08

[52] U.S. Cl. ..... 355/3 DD; 118/655

[58] Field of Search ..... 355/3 DD, 4; 118/655, 118/DIG. 24

[56] References Cited

U.S. PATENT DOCUMENTS

| | | | |
|---|---|---|---|
| 3,303,817 | 2/1967 | Cranch et al. | 118/655 |
| 3,924,944 | 12/1975 | Smith et al. | 355/3 DD |

*Primary Examiner*—A. D. Pellinen

*Attorney, Agent, or Firm*—Michael J. Striker

[57] ABSTRACT

An electro-photographic copier has a developer station that can be moved into and out of the copier. To avoid spillage of the developer material when the station is so moved, a mechanical transmission reverses the conveyor for the developer material when the station is unlatched preparatory to the movement.

9 Claims, 5 Drawing Figures

ELECTRO-PHOTOGRAPHIC COPIER WITH ANTI-SPILL ARRANGEMENT

BACKGROUND OF THE INVENTION

This invention relates to copiers in general, and in particular to an electro-photographic copier.

Copying apparatus of this type operates on the xerographic principle, i.e. an electrostatic charge is formed on a carrier surface and is then partially negated, leaving on the carrier surface a patterned charge corresponding to the image of an original (or of an original copy) to be reproduced. Powdered xerographic material is then applied in a developing station to the carrier surface, whereas it adheres at those portions of the surface which still carry the charge.

The powdered xerographic material is stored at the developing station in a receptacle and cascaded over the carrier surface — usually the circumferential surface of a xerographic drum — by a small bucket conveyor or another type of conveying device. Since the xerographic material must be replenished from time to time, which can be done most conveniently outside the relatively crowded confines of the machine housing, it is known to arrange the components of the developing station, including the receptacle and conveyor, in form of a developing unit that can be pulled out of the machine for replenishment of the xerographic material and be pushed back into the machine to operative position adjacent the xerographic carrier. Such an arrangement has the additional advantage that the components of the unit are readily accessible for servicing when the unit is pulled out of the machine. When the unit is pushed into the machine into its operative position, it is latched in place with a suitable arrangement.

The conveyor, whether or not it be of the bucket type, is constantly loaded with a quantity of xerographic material, which is being advanced to the point at which it becomes discharged from the conveyor to cascade over the xerographic carrier. Thus, in the case of a bucket conveyor, there will always be a full bucket located adjacent the discharge point and ready to discharge its contents. Unlatching the developing unit and withdrawing it outwardly from its operative position, tends to cause these contents to become discharged at a time when this is not desired, i.e. when due to the outward movement of the unit the material will not be discharged onto the xerographic carrier but generally into the interior of the machine.

It is self-evident that this is intolerable because it would very rapidly dirty the interior of the machine. For this reason the prior art has proposed to provide a switch which is automatically operated when the developer unit is unlatched in preparation for withdrawal. The switch, in turn, initiates a brief reversal of a tandem motor which serves to drive the conveyor. In consequence, any xerographic material which approaches the discharge point on the conveyor, is moved back from the discharge point by a distance sufficient to prevent it from becoming accidentally and unintentionally spilled into the machine.

This principle is very sound; however, the structural solutions for carrying the principle into effect are rather complicated and expensive. They require the use of electrical and electronic components, such as the aforementioned tandem motor, relays, a timer or timing stage, and the like.

This is clearly undesirable, not only because the increased manufacturing expenses reflect unfavorably on the salability of the machine, but also because the relative complexity of these constructions tends to make them susceptible to malfunction which in turn undesirably increases maintenance expenses.

SUMMARY OF THE INVENTION

Accordingly, it is an object of the present invention to overcome the disadvantages of the prior art.

A more particular object of the invention is to provide a copying apparatus having an arrangement for briefly causing a xerographic-material conveyor to move in reverse upon unlatching of the developing unit, which arrangement is not possessed of the prior-art disadvantages.

Another object of the invention is to provide such an apparatus wherein the aforementioned arrangement is of very simple and inexpensive construction.

Still a further object of the invention is to provide a copying apparatus in question wherein the arrangement mentioned above operates on a purely mechanical basis.

A concomitant object of the invention is to provide such an arrangement as mentioned hereinbefore, which is highly reliable and requires only minimal servicing and upkeep.

Pursuant to the above objects, and to others which will become apparent hereafter, a feature of the invention resides in an electro-photographic apparatus which, briefly stated, comprises a carrier having a surface on which an electrostatic latent image is formed, a developing unit for the image, comprising a housing and an endless conveyor mounted in the housing for movement in a direction so as to cascade developer material over the surface to thereby develop the latent image, mounting means mounting the unit for movement between an operating position adjacent to and a retracted position spaced from the carrier, operating means for locking the unit in the operating position and for unloading the unit in preparation for movement to the retracted position, and motor-transmitting means operatively connected with the conveyor and the operating means for imparting to the conveyor an increment of movement counter to the direction in response to actuation of the operating means for unlocking the unit.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
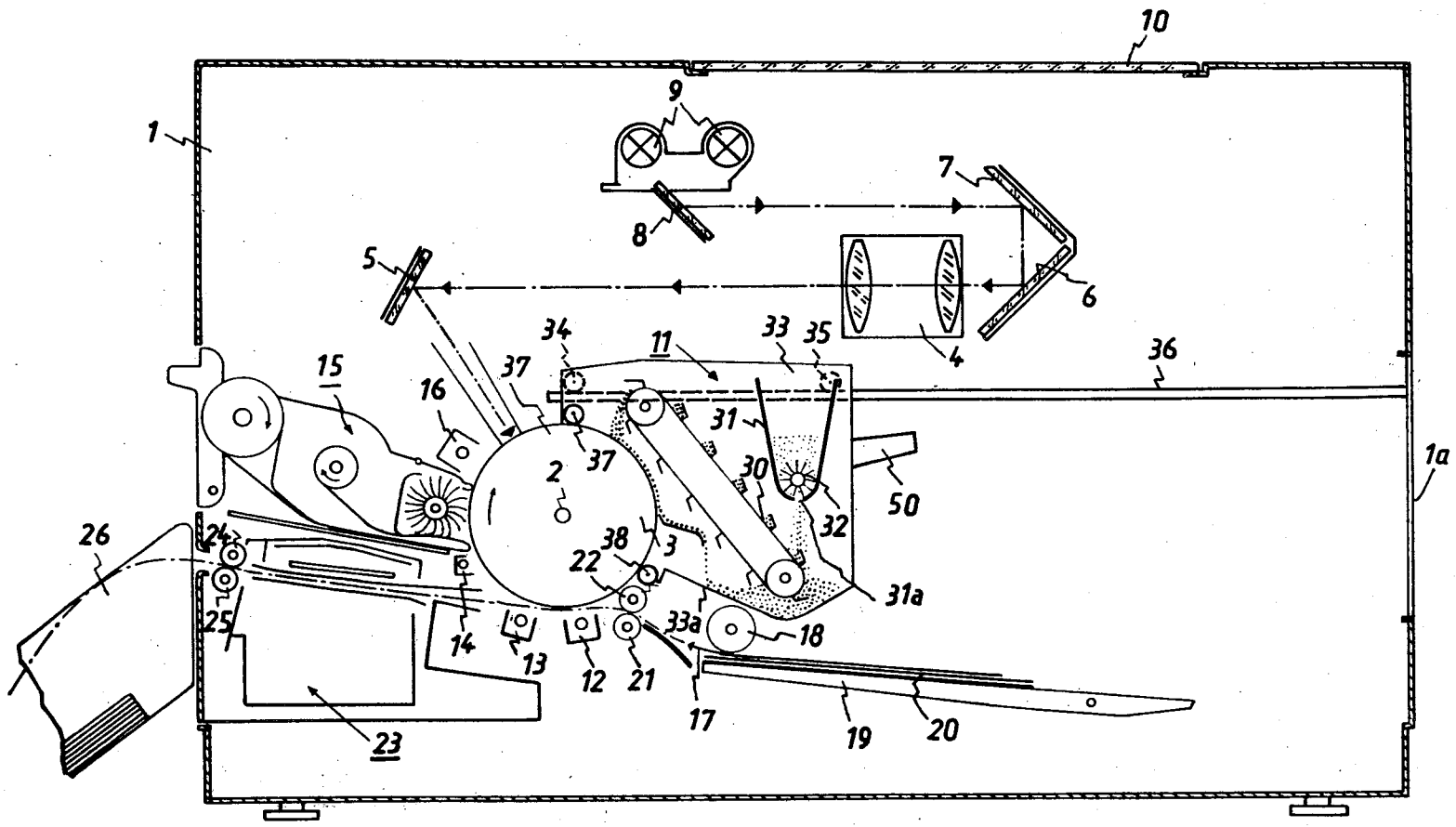
FIG. 1 is a somewhat diagrammatic vertical section through a copying apparatus according to the invention.

A first exemplary embodiment of the invention is illustrated in FIGS. 1–4. FIG. 1 shows somewhat diagrammatically an electro-photographic copying apparatus having a frame or a housing 1 in which a drum 3 having a xerographic surface is mounted for rotation about a shaft 2. The drum is driven in direction of the arrow, motion being transmitted to it from the main drive motor (not shown) of the apparatus. The drive is not shown, since it is known per se from other drum-type prior-art xerographic copiers.

The frame or housing 1 is provided with a window having a transparent support plate 10. An original, or an original copy to be reproduced (not shown) is placed face down onto the plate 10. An illuminating and scanning station for the original comprises the conventional (known per se from the prior art) optical system 4, stationary mirror 5, movable mirrors 6–8 and light source 9. These components serve to illuminate and stripwise scan the face of an original on the plate 10 and the reflected light beams travel via mirrors 5–8 to the optical system 4 which projects the scanned image onto the circumferential surface of the drum 3.

Angularly spaced about the drum 3 are other elements known per se, such as a developing unit 11 at which xerographic developing material is cascaded over the drum 3 to adhere to only those surface portions thereof where the light beams carrying from optical system 4 have not dissipated the uniform electrostatic charge which was previously applied to the drum surface by a charging corona. Arranged subsequent to the developing unit, as considered in the direction of rotation of the drum 3, are a transfer corona which causes the powder image to become transferred to a copy sheet 17, a detaching corona 13 which detaches the copy sheet 17 from the drum 3, a pre-cleaning corona 14 which removes the major part of any residual powder adhering to the drum 3, a brushing station at which remaining powder particles are brushed off the drum, and a discharging corona 16 for discharging residual electrostatic charges uniformly from the drum.

The copy sheets 17 are guided off a stack 20 on a table 19, by a roller 18, fed into the nip between rollers 21, 22 and supplied to the drum 3 to travel between the same and the coronas 12, 13. After receiving the powder image, the sheets 17 travel through a known fixing station and are then gripped and deposited on a copy tray by nip rollers 24, 25.

The developing unit comprises several components, namely a container 31 for developer material, a rotatable brush 32 or other instrumentality for discharging the material through an opening 31 in the bottom of the container, and a bucket conveyor 30 for picking up the material and transporting it upwardly to the discharge and of the conveyor, from where the material cascades over the drum 3. The conveyor 30 and the brush 32 are both driven by an electric motor (not shown). Excess developer material, i.e. that which does not adhere to the drum 3, drops onto an inclined bottom wall **33*a* of the unit 11 and slides along this wall until it reaches the lowest point of housing 33 at which it is picked up again by the conveyor 30**.

Figure 2:
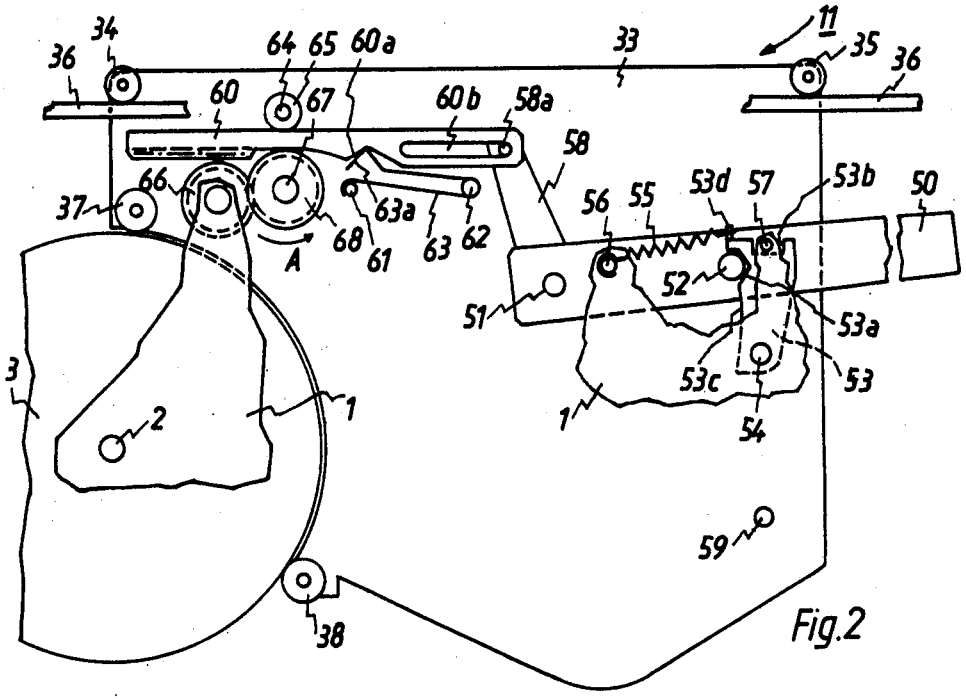
FIG. 2 is a fragmentary partly sectioned detail view, showing the developing unit of the apparatus of FIG. 1 in its operating position.

To make the unit 11 withdrawable for replenishment of developer material and for servicing, the housing 33 is provided with rollers 34, 35 which support it on guide rails 36 (one shown) so that the housing 33 can move radially of drum 3 to and from the operating position shown in FIGS. 1 and 2. In the latter Figure, certain components of the unit 11, e.g. conveyor 30, are omitted for clarity. When in this operating position, the unit 11 is supported by the drum via rollers 37 and 38. When it is withdrawn the unit 11 is moved out through a door 1a in housing or frame 1.

It is important that once the unit 11 is in operating position, it not be able to move relative to this position, unless this is specifically intended. For this purpose, a latching arrangement is provided. A lever 50 is pivotable about a shaft 51 mounted on the housing 33; it carries a pin 52 which becomes lodged in a recess **53*a* of a member 53 when the latching arrangement is in latching position (FIG. 2). Member 53 is pivotable about a shaft 54 mounted on frame or housing 1; the pivoting movement of member 53 is limited by a projection 57 which is mounted on a fixed machine part and extends into a recess 53*b***.

In operation of this arrangement, namely when lever 50 is operated to latch unit 11 in place, the pin 52 engages a cam face of member 53 and via this engagement the unit 11 is urged towards the circumference of drum 11, so that the rollers 37, 38 engage this circumference. A spring 55 is secured to a projection 56 of the machine and a projection **53*d* of member 53 and arrests the lever 50 in its latching position, assuring that unit 11 is reliably urged against drum 3 when lever 50 is in this latching position. The components necessary to achieve the purposes of the present invention will now be explained. They include a rack 60 which is located intermediate a supporting roller 65 mounted for rotation about a shaft 64 that is secured in the housing 33 of the unit 11 and a gear 68 that is secured on a shaft 67 which drives — in a manner not illustrated, but known per se — the conveyor 30. The rack 60 is urged against the supporting roller 65 by means of a leaf spring 63 which is mounted on pins 61, 62 of the unit 11. The rack 60 has a wedge-shaped recess 60a (compare, e.g. FIG. 2) into which a bent end portion 63a of the leaf spring 63 engages. Since the left-hand flank of the recess or notch 60a and the left-hand side of the end portion 63 are both inclined essentially in the same direction, the spring 63 tends to shift the rack 60 towards the left hand in FIG. 2 as well as pressing it upwardly against the roller 65, thus maintaining the rack 60 normally in the position shown in FIG. 2. The right-hand end portion of the rack 60 is formed with an elongated slot 60b into which a pin 58*a* engages which is mounted on an arm 58 that is in turn fixedly connected to the lever 50 for movement with the same, the lever 50 and the arm 58 being pivoted at 51** for joint pivoting movement.

A gear 66 is mounted on the housing or frame 1 of the apparatus (shown fragmentarily in FIG. 2) and is driven by the non-illustrated earlier mentioned electric motor. When the unit 11 is in the operating position shown in FIG. 2, the gear 66 meshes with the gear 68, thus driving the same in the direction of the arrow A and thereby advancing the conveyor 30 in counterclockwise direction in FIG. 1. In this position, the teeth **60*c* of the rack 60 are out of engagement with the teeth of the gear 68**.

Figure 3:
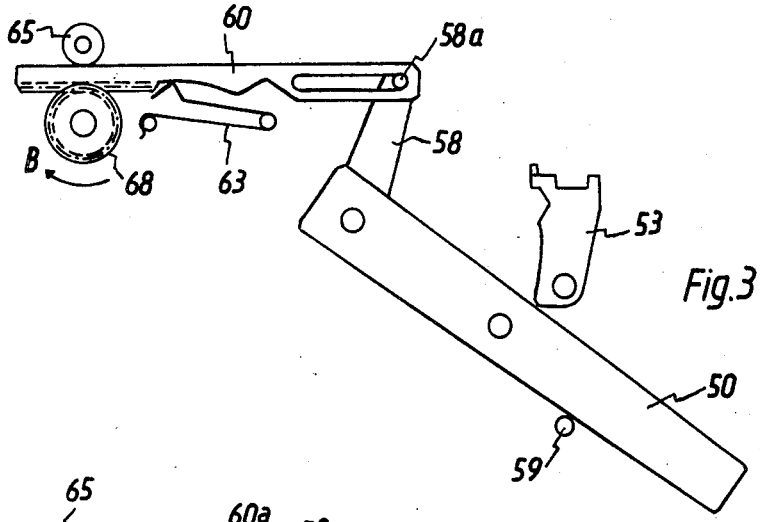
FIG. 3 is a diagrammatic detail view, showing an arrangement according to the invention in the position it assumes when the latching mechanism of the associated developing unit is in unlatching position.
Figure 4:
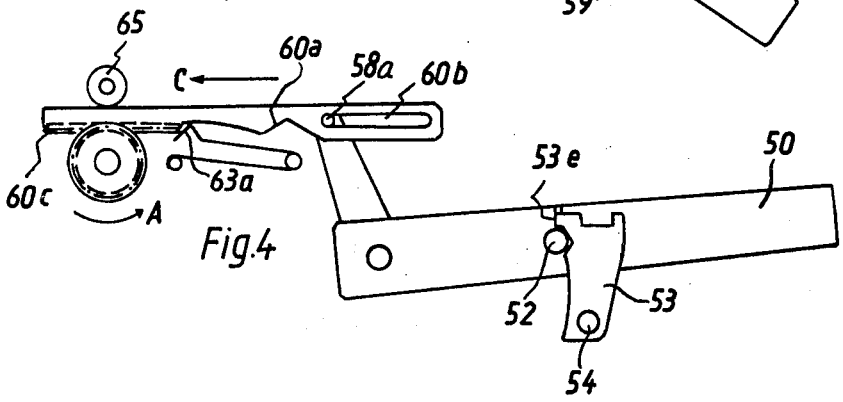
FIG. 4 is a view similar to FIG. 3, showing the arrangement when the latching mechanism is in the latching position but before operation of the machine begins.

When it is desired to withdraw the unit 11 through the door **1*a*, the lever 50 is pivoted downwardly (in FIG. 2) until it engages the projection 59 (as shown in FIG. 3). Since the arm 58 is rigidly connected with the lever 50, it performs the same angular movement as the same and thus pulls the rack 60 towards the right in FIG. 2 via the pin 58***a*, so that the teeth of the rack 60 now engage with the teeth of the gear 68. It will be understood that before the unlatching movement of the lever 50 is begun, the electric motor driving the gear 66 is deenergized or else disengaged from the gear 66 so that the gear 68 is no longer being driven in the direction of the arrow A. The engagement of the teeth of the rack 60 with the teeth of the gear 68 as the rack 60 moves toward the right to the position shown in FIG. 3, causes the gear 68 to be rotated through a fixed angular distance in the direction of the arrow B, i.e. counter to the normal operating direction A, which in turn causes the bucket conveyor 30 to be turned in clockwise direction through a similarly fixed distance so that the bucket closest to the upper discharge point (compare FIG. 1) is retracted downwardly from this discharge point and no accidental discharge of the developing material in this bucket can take place. The unit 1 can now be pulled along the rails 36 and out through the door 1a without any danger that the developing material might be spilled. When it is subsequently desired to return the unit 11 to operating position, then it is pushed through the door 1a along the rails 36 until it resumes the position shown in FIGS. 1 and 2. The lever 50 is now pivoted upwardly as shown in FIG. 4 until the projection 53 and the pin 52 engage and the arrangement is latched securely. During this displacement of the lever 50 the pin 58*a* of the arm 58 slides towards the left (see FIG. 4) in the slot 60*b*. The slot *b*, however, has such a length that by the time the pin 58*a* reaches the left-hand end of the slot 60*b*, the lever 50 will be in the latching position shown in FIG. 4, i.e. by this time no leftward movement of the rack 60 will have commenced from the position shown in FIG. 4. Thus, the conveyor 30 remains stationary at this time. This assures that there is no way for the conveyor 30 to be advanced again in the discharge direction until the unit 11 is properly positioned and arrested in the machine. Thus, any pivoting of the lever 50 from the position of FIG. 3 to the position of FIG. 4 that is carried out accidentally before the unit 11 is in the proper position for operation, cannot cause accidental discharge of developing material from the conveyor 30.

Once the position of FIG. 4 has been reached and the unit 11 has latched in position, the electric motor can again be energized, i.e. the copying apparatus can be started up for making copies. When this take place, the gear 68 is driven in the direction of the arrow A by the gear 66, and this causes the rack 60, the teeth 60c of which are still in mesh with the teeth of the gear 68, to be shifted leftward in FIG. 4, i.e. in the direction of the arrow C, until the teeth 60*c* of the rack 60 move out of mesh with the teeth of the gear 68. At the moment this takes place, the projection 63*a* of the spring 63 is already located at the left end of the left-hand flank of the notch 60*a*, urging the rack 60 leftward and causing it to move by a small increment beyond the gear 68, so that any engagement of the tooth located at the right-hand end of the set of teeth 60*c* of the rack 60 with the teeth of the gear 68 is reliably prevented during the copying operation. This spacing between the right-hand end one of the teeth 60*c* and the gear 68 is clearly visible in FIG. 2.

Of course, the delay in displacing the rack 60 leftward when the lever 50 is moved from the position of FIG. 3 to the position of FIG. 4 could be achieved otherwise than by the sliding movement of the pin 58*a* in the slot 60*b* of the rack 60. This, however, is a very simple and highly reliable solution to the problem of preventing accidental or unintentioned movement of the conveyor 30 in the discharge direction before the unit 11 is in proper operating position and latched. It would also be possible to omit the leftward biasing function inserted by the projection or end portion 63*a* of the spring 63 upon the rack 60 at the time the copying operation is resumed, i.e. the function which shifts the right-hand one of the teeth 60*c* out of engagement with the teeth of the gear 68. However, the illustrated solution is advantageous because it eliminates any possible noises and any possible damage to the respective components.

Figure 5:
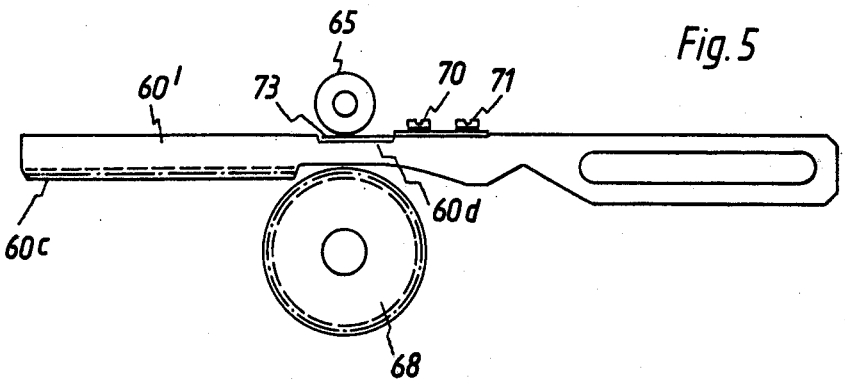
FIG. 5 is a fragmentary detail view, showing a further embodiment of the invention.

A further embodiment is illustrated in FIG. 5. Actually, only the gear 68 and the cooperating rack 60' are shown, together with additional components characteristic of the further embodiment. All other elements correspond to those shown in FIGS. 1–4.

FIG. 5 shows that the rack 60 may be provided at its side facing towards the roller 65 with a depression 60*d* and with a leaf spring 73 which is secured to the rack 60 by means of the screws or analogous elements 70, 71. This arrangement prevents any interference with the movement of the gear 68 in the direction of the arrow B (see FIG. 3) during the rightward movement of the rack 60' which results from displacement of the lever 50 from the position of FIG. 4 to the position of FIG. 3. If, during such rightward displacement, the tip of the tooth at the right-hand end of the set of teeth 60*c* on the rack 60' happens to engage the tip of a tooth on the gear 68, the rack 60' can yield in direction upwardly away from the gear 68 since such yielding simply results in the portion of the leav spring 73 which overlies the recess 60*d* being pressed into this recess. Thus, the two interfering teeth on the rack 60' and the gear 68 can bypass one another, i.e. the right-hand end tooth on the rack 60' can bypass the interfering tooth on the gear 68 and mesh with the next two thereof. In this position the rack 60' can no longer yield in upward direction, since it has already moved far enough to the right in FIG. 5 so that the roller 65 is now juxtaposed with a portion of the rack which is not provided with the depression or recess 60*d*.

This embodiment, which may of course use a different resiliently yieldable element than the leaf spring 73, further increases the reliability of operation of the novel copier, since it assures absolutely that nothing can interfere with the rightward movement of the rack 60' and consequently with the rotation of the gear 68 in the direction of the arrow B to move the conveyor 30 in a sense preventing spillage of developer material.

The novel copier is susceptible of various modifications which are considered to be encompassed within the scope of the appended claims. Thus, springs other than the recited and illustrated leaf springs could be utilized, the member 53 could have a shape different from that illustrated, the housing 33 of the unit 11 could be configurated differently than what is shown and other modifications could be made.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electro-photographic copier, comprising a carrier having a surface on which an electrostatic latent image is formed; a developing unit for said image, comprising a housing and an endless conveyor mounted in said housing for movement in a direction so as to cascade developer material over said surface to thereby develop said latent image, said conveyor comprising a gear which normally advances in a sense moving said conveyor in said direction; mounting means mounting said unit for movement between an operating position adjacent to and a retracted position spaced from said carrier, operating means for locking said unit in said operating position and for unlocking the unit in preparation for movement to said retracted position; and motion-transmitting means operatively connected with said conveyor and said operating means for imparting to said conveyor an increment of movement counter to said direction in response to actuation of said operating means for unlocking said unit, said motion-transmitting means comprising a rack which engages said gear and entrains it counter to said sense in response to unlocking of said unit, said rack having a row of teeth and the length of sand row being such that said teeth are disengaged from said gear when said unit is locked.

2. An electro-photographic copier, comprising a carrier having a surface on which an electrostatic latent image is formed; a developing unit for said image, comprising a housing and an endless conveyor mounted in said housing for movement in a direction so as to cascase developer material over said surface to thereby develop said latent image; said conveyor comprising a gear which normally advances in a sense moving said conveyor in said direction; mounting means mounting said unit for movement between an operating position adjacent to and a retracted position spaced from said carrier; operating means for locking said unit in said operating position and for unlocking the unit in preparation for movement to said retracted position; and motion-transmitting means operatively connected with said conveyor and said operating means for imparting to said conveyor an increment of movement counter to said direction in response to actuation of said operating means for unlocking said unit, said motion-transmitting means comprising a rack which engages said gear and entrains it counter to said sense in response to unlocking of said unit, said rack having a portion connected with said operating means, said operating means being movable between a first and a second position during locking of said unit, and said rack remaining stationary during the movement of said operating means to said second position.

3. A copier as defined in claim 2, said portion of said rack having a longitudinally extending slot, and said operating means comprising a pivotable lever provided with a projection which is slidably received in said slot.

4. A copier as defined in claim 3, said rack being longitudinally movable through a predetermined distance relative to said gear, and said slot having a length corresponding to said predetermined distance.

5. A copier as defined in claim 4, wherein said rack is movable to and from a position which it assumes when said unit is locked; and further comprising latch means for maintaining said rack out of engagement with said gear when said rack is in said position.

6. A copier as defined in claim 5, wherein said latch means comprises a spring.

7. A copier as defined in claim 5, said rack having a notch at one side, said latch means comprising a biasing spring engaged in said notch, and a support roller engaging said rack at an opposite side from said one side and maintaining the rack against deflection out of mesh with said gear by said spring.

8. An electro-photographic copier, comprising a carrier having a surface on which an electrostatic latent image is formed; a developing unit for said image, comprising a housing and an endless conveyor mounted in said housing for movement in a direction so as to cascase developer material over said surface to thereby develop said latent image, said conveyor comprising a gear which normally advances in a sense moving said conveyor in said direction; mounting means mounting said unit for movement between an operating position adjacent to and a retracted position spaced from said carrier; operating means for locking said unit in said operating position and for unlocking the unit in preparation for movement to said retracted position, said operating means being movable between a first and a second position during locking of said unit; and motion-transmitting means operatively connected with said conveyor and said operating means for imparting to said conveyor an increment of movement counter to said direction in response to actuation of said operating means for unlocking said unit, said motion-transmitting means comprising a rack which engages said gear and entrains it counter to said sense in response to unlocking of said unit, said rack having a row of teeth of such a length that said teeth are disengaged from said gear when said unit is locked and a portion connected with said operating means, said rack remaining stationary during the movement of said operating means to said second position thereof, said rack being longitudinally movable through a predetermined distance relative to said gear to and from a position which it assumes when said unit is locked and said portion of said rack having a longitudinally extending slot of a length corresponding to said predetermined distance, and said operating means comprising a pivotable lever provided with a projection which is slidably received in said slot; and latch means for maintaining said rack out of engagement with said gear when said rack is in said position, said rack having a notch and also said teeth located at one side of said latch means comprising a biasing spring engaged in said notch, and a support roller engaging said rack at an opposite side from said one side and maintaining the rack against deflection out of mesh with said gear by said spring, said rack having at said other side a resiliently yieldable element positioned for contact with said support roller when said rack is in a position in which said rack and said gear first come into mesh.

9. A copier as defined in claim 8, wherein said other side is formed with a recess and said resiliently yieldable element is a leaf spring overlying said recess.

* * * * *